US008766760B2

(12) United States Patent
Weber et al.

(10) Patent No.: US 8,766,760 B2
(45) Date of Patent: Jul. 1, 2014

(54) SWITCHGEAR UNIT FOR SWITCHING HIGH DC VOLTAGES

(75) Inventors: Waldemar Weber, Nuremberg (DE); Klaus Werner, Roethenbach (DE); Hubert Harrer, Hilpoltstein (DE); Wolfgang Schmidt, Berg (DE)

(73) Assignee: Ellenberger & Poensgen GmbH, Altdorf (DE)

( * ) Notice: Subject to any disclaimer, the term of this patent is extended or adjusted under 35 U.S.C. 154(b) by 90 days.

(21) Appl. No.: 13/537,918

(22) Filed: Jun. 29, 2012

(65) Prior Publication Data

US 2012/0268233 A1 Oct. 25, 2012

Related U.S. Application Data

(63) Continuation of application No. PCT/EP2011/005616, filed on Nov. 9, 2011.

(30) Foreign Application Priority Data

Jan. 25, 2011 (DE) ..... 20 2011 001 891 U
Mar. 30, 2011 (DE) ..... 10 2011 015 449

(51) Int. Cl.
*H01H 85/00* (2006.01)
*H01H 71/20* (2006.01)
*H01H 85/02* (2006.01)

(52) U.S. Cl.
USPC ..... 337/5; 337/187; 337/144

(58) Field of Classification Search
USPC ..... 337/5, 187, 144
See application file for complete search history.

(56) References Cited

U.S. PATENT DOCUMENTS

| | | | | | |
|---|---|---|---|---|---|
| 2,150,012 | A | * | 3/1939 | Von Hoorn | 337/60 |
| 2,199,622 | A | * | 5/1940 | Dorfman | 337/75 |
| 2,329,362 | A | * | 9/1943 | Swingle | 337/53 |
| 2,811,606 | A | * | 10/1957 | Norden | 337/53 |
| 2,843,702 | A | * | 7/1958 | Edmunds | 337/7 |
| 2,908,782 | A | * | 10/1959 | Kiesel et al. | 335/9 |
| 2,924,686 | A | * | 2/1960 | Edmunds | 337/7 |
| 3,043,939 | A | * | 7/1962 | Gryctko et al. | 218/152 |
| 3,211,860 | A | * | 10/1965 | Stephenson, Jr. et al. | 337/50 |
| 3,213,249 | A | * | 10/1965 | Ellsworth et al. | 337/52 |

(Continued)

FOREIGN PATENT DOCUMENTS

| | | | | |
|---|---|---|---|---|
| DE | 1128009 B | | 4/1962 | |
| EP | 105945 A1 | * | 4/1984 | H01H 71/52 |
| EP | 1 953 788 A1 | | 8/2008 | |

*Primary Examiner* — Bradley Thomas
(74) *Attorney, Agent, or Firm* — Laurence A. Greenberg; Werner H. Stemer; Ralph E. Locher

(57) ABSTRACT

A switchgear unit switches high DC voltages, particularly for interrupting of direct current between a direct current source and an electrical device. The switchgear unit contains two connections which project from a housing and which are electrically conductively coupled by a conductor path, a contact system which is arranged between the first and second connections and an isolating apparatus that can be tripped by a thermal fuse. The thermal fuse contains a melting location which is arranged in the conductor path and which is connected first to the contact system and second via a moving conductor section to the first connection. The isolating apparatus is tripped and the connection between the conductor section and the contact system is broken at the melting location when an arc produced when the contact system is opened has caused the melting temperature of the melting location to be reached or exceeded.

21 Claims, 5 Drawing Sheets

(56) References Cited

U.S. PATENT DOCUMENTS

| | | | | | |
|---|---|---|---|---|---|
| 3,533,038 | A | * | 10/1970 | Myers et al. | 337/6 |
| 3,566,326 | A | * | 2/1971 | Middendorf et al. | 337/55 |
| 3,697,915 | A | * | 10/1972 | Brassard | 337/74 |
| 3,796,980 | A | | 3/1974 | Ellsworth | |
| 3,958,197 | A | * | 5/1976 | Gryctko | 335/18 |
| 4,034,326 | A | | 7/1977 | Hill et al. | |
| 4,325,041 | A | * | 4/1982 | Murai | 335/35 |
| 4,393,288 | A | * | 7/1983 | Belttary | 218/155 |
| 4,458,225 | A | * | 7/1984 | Forsell | 335/35 |
| 4,604,596 | A | * | 8/1986 | Yokoyama et al. | 335/14 |
| 4,752,660 | A | * | 6/1988 | Yokoyama et al. | 218/117 |
| 5,264,818 | A | * | 11/1993 | Truchet et al. | 337/79 |
| 5,463,199 | A | | 10/1995 | Divincenzo et al. | |
| 5,780,800 | A | * | 7/1998 | Palmieri et al. | 218/147 |
| 5,859,578 | A | * | 1/1999 | Arnold | 337/110 |
| 5,936,495 | A | | 8/1999 | Lecourt | |
| 6,084,193 | A | * | 7/2000 | Pellon | 218/117 |
| 6,445,273 | B1 | * | 9/2002 | Yu | 337/37 |
| 6,498,310 | B1 | * | 12/2002 | Bugryn | 200/308 |
| 6,512,441 | B1 | * | 1/2003 | Yu | 337/37 |
| 2001/0006365 | A1 | * | 7/2001 | Yu | 337/68 |
| 2001/0024154 | A1 | * | 9/2001 | Toyama et al. | 337/12 |
| 2006/0186984 | A1 | * | 8/2006 | Ullermann | 337/14 |
| 2009/0213518 | A1 | * | 8/2009 | Domejean et al. | 361/111 |
| 2010/0127816 | A1 | * | 5/2010 | Hofmann et al. | 337/70 |
| 2011/0193675 | A1 | * | 8/2011 | Darr et al. | 337/187 |
| 2011/0221563 | A1 | * | 9/2011 | Su et al. | 337/149 |
| 2012/0086539 | A1 | * | 4/2012 | Duval et al. | 337/1 |
| 2012/0086540 | A1 | * | 4/2012 | Duval et al. | 337/1 |

* cited by examiner

SWITCHGEAR UNIT FOR SWITCHING HIGH DC VOLTAGES

CROSS-REFERENCE TO RELATED APPLICATION

This application is a continuation application, under 35 U.S.C. §120, of copending international application No. PCT/EP2011/005616, filed Nov. 9, 2011, which designated the United States; this application also claims the priority, under 35 U.S.C. §119, of German patent application No. DE 20 2011 001 891, filed Jan. 25, 2011, and German patent application No. DE 10 2011 015 449, filed Mar. 30, 2011; the prior applications are herewith incorporated by reference in their entireties.

BACKGROUND OF THE INVENTION

Field of the Invention

The invention relates to a switchgear unit for switching high DC voltages, particularly for interrupting direct current between a direct current source and an electrical device. The switchgear unit has two connections which project from a housing and which are electrically conductively coupled by a conductor path, and a mechanical contact system, arranged between the first and second connections. The switchgear unit further has two contacts which can move relative to one another and can be transferred from a closed position to an open position, and also an isolating apparatus, which can be tripped by a thermal fuse, for extinguishing an arc which is produced when the contacts are opened. In this context, a direct current source is intended to be understood to mean particularly a photovoltaic (PV) generator (solar installation), and an electrical device is intended to be understood to mean particularly an inverter.

When relatively high DC voltages up to 1,500 V (DC) are switched, the high field strengths (as a result of gas ionization) produce conductive channels in such switchgear units between the contact zones, the conductive channels being known as electrical arcs or arc plasmas. The arc produced when isolating the switching contacts needs to be extinguished as quickly as possible, since the arc releases a large amount of heat (gas temperature of several thousand degrees Kelvin) which results in severe heating of the switching contacts and of the surroundings. This severe heating can result in damage to the switchgear unit, for example burning of the switchgear unit, and also to the superordinate installation unit.

German utility model DE 20 2008 010 312 U1 discloses a PV installation or solar installation having what is known as a PV generator, which for its part comprises grouped solar modules combined to form generator elements. The solar modules are connected in series or are in parallel lanes. Whereas a generator element outputs its direct current power via two terminals, the direct current power of the entire PV generator is fed to an AC voltage system via an inverter. In order to keep down the wiring complexity and power losses between the generator elements and the central inverter in this case, what are known as generator terminal boxes are arranged close to the generator elements. The direct current power accumulated in this way is usually routed to the central inverter by a common cable.

Depending on the system, PV installations continuously deliver an operating current and an operating voltage in a range between 180 V (DC) and 1,500 V (DC). Reliable isolation of the electrical components or devices from the PV installation acting as a direct current source is desirable for installation, assembly or servicing purposes, for example, and also particularly for the general protection of persons. An appropriate isolating apparatus needs to be capable of performing interruption under load, which is to say without prior disconnection of the direct current source.

For load isolation, it is possible to use mechanical switches (switching contact). These have the advantage that when the contacts have been opened there is likewise DC isolation produced between the electrical device (inverter) and the direct current source (PV installation).

Such switchgear units are known generally from the prior art. The arcs produced when the contacts are opened under load are quickly moved to extinguishing apparatuses provided for this purpose, where the appropriate arc extinguishing takes place. The force required for this is provided by magnetic fields, what are known as blowing fields, which are typically produced by one or more permanent magnets. Special design of the contact zones and of the arc conducting piece routes the arc into appropriate extinguishing chambers, where the arc extinguishing takes place on the basis of known principles.

Such extinguishing chambers comprise arc splitter stacks, for example. The materials used for the arc splitters are usually ferromagnetic materials, since the magnetic field which accompanies the arc strives to run through the arc splitters, which exhibit better magnetic conduction, in the vicinity of a ferromagnetic material. This produces a suction effect in the direction of the arc splitters, which effect results in the arc moving toward the arrangement of the arc splitters and being split between the latter.

In simple mechanical switchgear units, numerous sources of fault arise in practice which have an adverse effect on safe switching or even render it impossible. One possible fault is the absence of an arc-extinguishing part, such as an arc splitter or a blowing magnet. In addition, incorrectly assembled parts, for example as a result of the blowing magnet being inserted with the wrong polarity, can also likewise result in the switchgear unit failing. Particularly in the case of hybrid switch systems, there are further opportunities for fault on account of missing or defective electronic parts.

In order to put the PV installation into a state which is safe for humans and the installation in the event of such instances of fault occurring, the circuit needs to be permanently isolated so that the user can identify the fault and can replace the switchgear unit. When the installation is transferred to this state, the switching housing of the appliance must not be damaged or destroyed, so that the live portions remain insulated. The transfer in such an instance of fault is affected by what is known as a failsafe element of the switchgear unit, without the need for activation measures, for example manual intervention or the like, to be taken beforehand.

Typical failsafe elements are tripped by virtue of an admissible material-dependent current density (current intensity per surface area) being exceeded. In this case, an electrical conductor is melted and the circuit is interrupted. This is a customary method of identifying and disconnecting overcurrents, as is used in safety fuses, for example. This method cannot be used in PV installations, however, since it is not possible to assume a particular current density or current level in this case. On the contrary, the tripping or fault detection needs to be effected independently of current level.

Published, non-prosecuted German patent application DE 10 2008 049 472 A1 discloses a surge arrester having at least one dissipation element, and also having a disconnection apparatus, in which it is firstly possible for the at least one dissipation element to be disconnected in a manner implementable by thermal measures. Secondly, it is possible to bring about shorting in the event of further energy-related, in particular thermal, loading. In this case, there is a thermally detachable stopping device in the path of movement of a conductor section, moved by the disconnection apparatus, between a melting location and a conductive element that forms an opposing contact. In the event of tripping and in the case of an overload, the movement of the conductor section is interrupted by the stopping device before the end position is reached. In the event of a fault in which the disconnection apparatus cannot safely interrupt the current and an arc is produced, or continues to exist, between the fixed connection of the dissipation element and the conductor section, which corresponds to an additional input of heat, the stopping action is cancelled and the moving conductor section is moved to the end position. The clearance of the short and hence the disconnection of the surge arrester from the system are undertaken in a manner which is known per se by an upstream overcurrent protection device, particularly a fuse.

A failsafe element of this kind is likewise not suitable for the application outlined above, since, in this case too, the fault detection does not take place until a particular overcurrent has been reached. An arc which is present would also arise in the electric energy range of the switchgear unit at relatively high voltages in the event of a fault.

SUMMARY OF THE INVENTION

The invention is based on the object of specifying a switchgear unit of the type cited at the outset which can switch a high DC voltage reliably and safely. In particular, the switchgear unit is intended to be suitable for performing direct current interruption between a direct current source, particularly a PV generator, and an electrical device, particularly an inverter. In addition, the switchgear unit is intended to be set up to extinguish an arc which is produced in the event of a fault and which is not automatically extinguished within the switchgear unit, without the need for activation measures, for example manual intervention or the like, to be taken beforehand.

To this end, the switchgear unit contains two connections which project from the housing and which are electrically conductively coupled by a conductor path. Arranged between the first and second connections is a mechanical contact system having two contacts which can move relative to one another and can be transferred from a closed position to an open position. An isolating apparatus which can be tripped by a thermal fuse is used for extinguishing an arc which is produced when the contacts are opened. The thermal fuse contains a melting location which is arranged in the conductor path and which is connected first to the contact system and second via a moving conductor section to the first connection.

In the event of a fault—on account of the high voltage applied between the contact areas—an arc which is not automatically extinguished can form under load when the contact system is opened. The isolating apparatus is tripped and the connection between the conductor section and the contact system at the melting location is broken when the arc has caused the melting temperature of the melting location to be reached or exceeded.

The arc produced in the event of a fault is very energy rich. In contrast to the prior art, the thermal fuse is tripped or the melting location is melted by using not the current density in the event of an overcurrent but rather the heat energy produced by the arc, which heat energy increases disproportionately in the event of a fault. This results in a failsafe for the switchgear unit, which is tripped or has a fault detected independently of current level.

The thermal fuse in the switchgear unit therefore serves as a failsafe element which is suitable particularly for use in PV installations. In addition, the backup for the switchgear unit is inexpensive to manufacture and therefore meets the requirements of economic manufacturability.

In one expedient embodiment, the melting location is, in particular, a solder point which is broken when the response temperature is reached or exceeded. The solder material used between the contact system and the conductor section may be a fusible alloy, such as an aluminum/silicon/tin alloy or other generally known low-melting-point alloys. The melting point of such alloys is usually in the range from 150° C. to 250° C. This means that during rated operation the current is carried safely without tripping the thermal fuse. Alternatively, it is conceivable for other temperature-sensitive and electrically conductive materials to be used as a melting location material, such as an electrically conductive plastic.

According to the field of application, selection of the conductive and/or insulating materials of the switchgear unit allows a corresponding variation in the response temperature and/or tripping time to be achieved. It is also conceivable for suitable dimensioning and compilation of the materials used to allow such a switchgear unit to be used for lower voltages too.

In one advantageous development, the isolating apparatus contains a prestressed spring element. The spring restoring force acts indirectly or directly on the moving conductor section in a breaking direction. If the melting location is heated inadmissibly in the event of a fault, it is melted and the switchgear unit consequently prompts a system interruption on account of the spring restoring force. In particular, the prestressed spring element therefore allows automatic system interruption without the need for an activation measure to be taken by a person in the event of a fault.

When the melting location is broken, an arc likewise forms between the contact system on the one hand and the moving conductor section on the other. On account of the spring restoring force, the conductor section is moved away from the contact system and therefore the arc or the arc plasma is artificially extended. If this arc is extinguished in this manner, the arc between the contact areas of the contact system is also extinguished. The direct current source consequently has DC isolation from the electrical device.

In one suitable embodiment, the spring element deflects the conductor section about a pivot point, which is at a distance from the melting location, when the isolating apparatus is tripped. The pivot angle covered in this case is greater than or equal to 90°, in particular. The pivoting of the conductor section artificially extends the second arc and therefore cools it further. This additional extension or cooling ensures that the distance between the contact system and the conductor section is opened as quickly and as wide as possible in order to extinguish the (second) arc produced when the conductor section is detached and also the (first) arc which is present on the contact system. In this case, the spring restoring force is chosen to be of appropriately large enough size for the conductor section to be pivoted as quickly as possible, so that damage to the switching housing by the arcs is advantageously prevented.

In one suitable embodiment, the housing of the switchgear unit has an insulating chamber which adjoins the melting location. When the isolating apparatus has been tripped, the conductor section is pushed into this insulating chamber as a result of the spring restoring force. The insulating chamber is used for the physical and hence insulating isolation of the conductor section from the contact system, which advantageously assists in extinguishing the arc.

In a similarly suitable embodiment, the isolating apparatus has an isolating element which is held in the housing so as to move and which is directed against the conductor section. The melting location is naturally sensitive to external forces acting on it. On account of the aforementioned spring restoring force of the isolating apparatus on the conductor section, the melting location is subjected to relatively intense loading. As a result of the isolating element, the restoring force can begin effectively on a relatively large contact area on the conductor section. In other words, this means that the resulting torque acting at the melting location is advantageously reduced. As a result, there is less mechanical stress applied to the melting location.

In one suitable embodiment of the invention, the isolating element also begins close to the melting location on the conductor section, as a result of which the power arm and hence the effective torque at the melting location are reduced further. This torque, or the power arm length and/or the isolating element dimensioning, can be used as an additional parameter for dimensioning the response temperature and/or the tripping time for the dropout fuse in the switchgear unit or the isolating apparatus.

In one expedient development, when the isolating apparatus has been tripped, the conductor section is covered by the isolating element so as to be at least partially insulated from the melting location, as a result of which the arc is advantageously suppressed.

In one expedient refinement of the switchgear unit, the isolating element is directed in the housing so as to move in sliding fashion and, when the isolating apparatus is tripped, is moved into the insulating chamber together with the conductor section by the spring restoring force. As a result, the conductor section is covered completely in the tripped state. When the isolating apparatus is tripped, the further arc is squeezed in between the isolating element and the insulating chamber, on account of the conductor section being pivoted. Particularly fast and safe extinguishing of the arc is ensured by virtue of it being squeezed in.

In one preferred embodiment, the spring element in this case is a compression spring which pushes the isolating element into the insulating chamber in the breaking direction. To this end, the isolating element and the insulating chamber are of geometrically complementary design, so that the arc can be squeezed into the chamber and the conductor section can be completely concealed from the contact system by the isolating element. In this case, the squeezing-in length can be expediently matched to the performance parameters of the direct current source.

In an alternative, likewise advantageous refinement of the switchgear unit, the isolating element is held in the housing so as to move in rotary fashion. When the isolating apparatus is tripped, the conductor section is pivoted by the isolating element about the pivot point, which is at a distance from the melting location. In one expedient embodiment, the spring element is a leg spring by which a pivot lever pivots the conductor section in the event of a fault.

In a simple form of the invention, the contact system contains a moving contact and a fixed contact. Arranged between the fixed contact and the melting location is an electrically conductive contact carrier which couples the fixed contact and the melting location so as to conduct heat. Instead of a moving contact and a fixed contact, two moving contacts may also be provided. In this case, the thermal capacity or the melting point of the contact carrier is higher than that of the melting location. In one expedient embodiment, the contact carrier is produced from a material which is a good conductor of heat and electricity, such as copper, so that fast and reliable tripping of the isolating apparatus is ensured. In order to support the thermal conductivity (flow of heat per cross-sectional area and temperature gradient), the contact carrier can be shaped and dimensioned accordingly, for example by virtue of a taper on the carrier.

In one suitable development, the moving contact is coupled to a rocker lever for manually operating the contact system by a trip mechanism. In one typical embodiment, the tripping mechanism, the moving contact and the fixed contact form a (mechanical) snap contact system. In the case of such snap contact, the contacts are—as a result of operation—removed from one another as quickly as possible, typically in a few milliseconds, typically by a prestressed leg spring. This normally allows a (first) arc produced to be extinguished, so that the isolating apparatus is not tripped.

In a typical embodiment of the switchgear unit, the movable conductor section is a flexible connecting element, particularly a stranded conductor, the fixed end of which is soldered nondetachably to the first connection, and the loose end of which is soldered at the melting location, preferably to the contact carrier.

In a similarly typical embodiment, the housing of the switchgear unit holds the conductor path, the mechanical contact system, the isolating apparatus and the thermal fuse. As a result, the live portions of the switchgear unit are insulated from the surroundings. In particular, this advantageously protects a person operating the switchgear unit from the high voltages and currents which are applied.

In one advantageous refinement, the housing and the isolating element are made from a thermally stable plastic material, particularly from a thermoset material. This ensures that the high level of heat generation on account of the arc does not damage or destroy the switchgear housing. As a result, the live portions continue to be insulated so as to be safe to touch in the event of a fault. In addition, it is ensured that the isolating element is not damaged or destroyed by the second arc in the region of the melting location. As a result, the isolating element can reliably isolate the switchgear unit from the system in the event of a fault.

In one suitable embodiment, the isolating element and/or the insulating chamber are made from a plastic material which degases in the event of fire, particularly from polyamide. By way of example, polycarbonate or polyoxymethylene are likewise suitable. The plastic degassing operations advantageously contribute to fast extinguishing of the (second) arc. In particular, the gases hamper ionization of the air gap in the region of the severed melting location, or help the ionization to die down faster.

The interaction with the choice of suitable plastics for housing, insulating chamber and isolating element, the shape and the material of the contact carrier and the dimensioning of the squeezing-in and also the torque acting on the melting location allow exact tripping of the isolating apparatus in the event of a fault and reliable extinguishing of the arc.

In respect of a disconnection apparatus for interrupting direct current between a direct current source and an electrical device, particularly between a PV generator and an inverter, the stated object is achieved by a live switchgear unit according to the invention.

In one expedient embodiment of the switchgear unit, the connections and the housing are, to this end, suitable and set up for a printed circuit board assembly. In the case of the preferred used of the switchgear unit, the disconnection apparatus is therefore particularly suitable for reliable and touch-safe interruption of direct current both between a PV installation and an inverter associated therewith and in connection with a fuel cell installation or an accumulator (battery), for example.

Other features which are considered as characteristic for the invention are set forth in the appended claims.

Although the invention is illustrated and described herein as embodied in a switchgear unit for switching high DC voltages, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
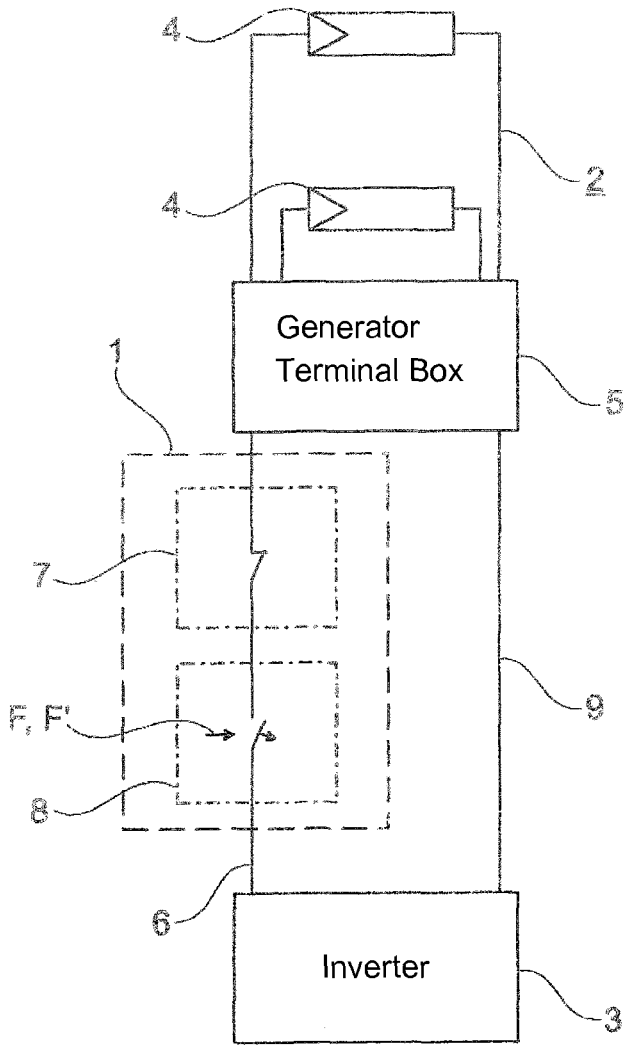
FIG. 1 is a block diagram of a switchgear unit according to the invention with a failsafe system between a PV generator and an inverter according to the invention.

Parts and magnitudes which correspond to one another have always been provided with the same reference symbols in all figures. Referring now to the figures of the drawing in detail and first, particularly, to FIG. 1 thereof, there is shown schematically a switchgear unit 1 which, in the exemplary embodiment, is connected between a PV generator 2 and an inverter 3. The PV generator 2 contains a number of solar modules 4 which are directed, in a situation parallel to one another, to a common generator terminal box 5, which effectively serves as an assembly point.

In a main current path 6 representing the positive terminal, the switchgear unit 1 generally contains two subsystems for DC isolation of the PV generator 2 from the inverter 3. The first subsystem is a manually operable mechanical contact system 7, and the second subsystem is a failsafe system 8 which trips automatically in the event of a fault. The failsafe system 8 ideally is a thermal fuse 8. In a return line 9, representing the negative terminal, of the switchgear unit 1—and hence of the overall installation—there may be further contact and failsafe systems 7, 8 connected in a manner which is not shown in more detail.

FIGS. 2 to 6 show a variant of the switchgear unit 1 according to the invention in a detailed illustration. The switchgear unit 1 contains a housing 10 from which two connections (external connections) 11 and 12 project. The switchgear unit 1 is connected to the main current path 6 between the PV generator 2 and the inverter 3 by the connections 11 and 12.

The contact system 7 furthermore contains a contact crossbar 15, which can be operated manually by a rocker lever 13 and a coupling lever 14, as a moving contact and a contact carrier 16 as a fixed contact is formed. The contacts or contact areas 17*a* and 17*b* between the contact crossbar 15 and the contact carrier 16 are in the form of platelet-like contact elements.

Figure 2:
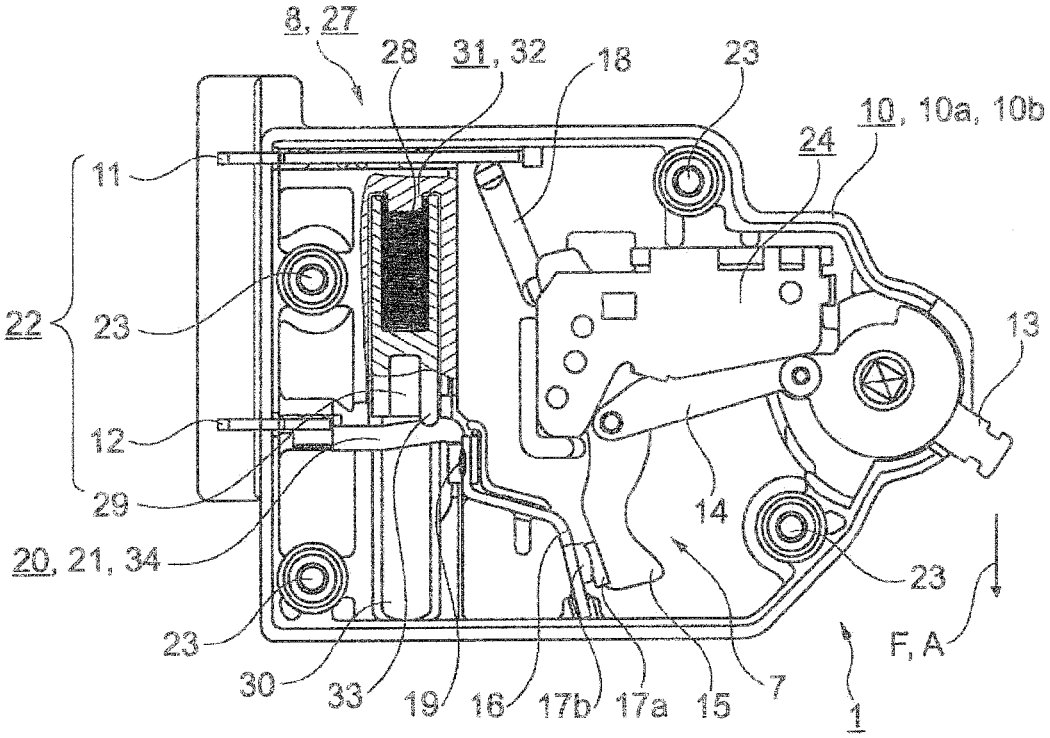
FIG. 2 is a diagrammatic, sectional view of the switchgear unit in a closed switching state.
Figure 3:
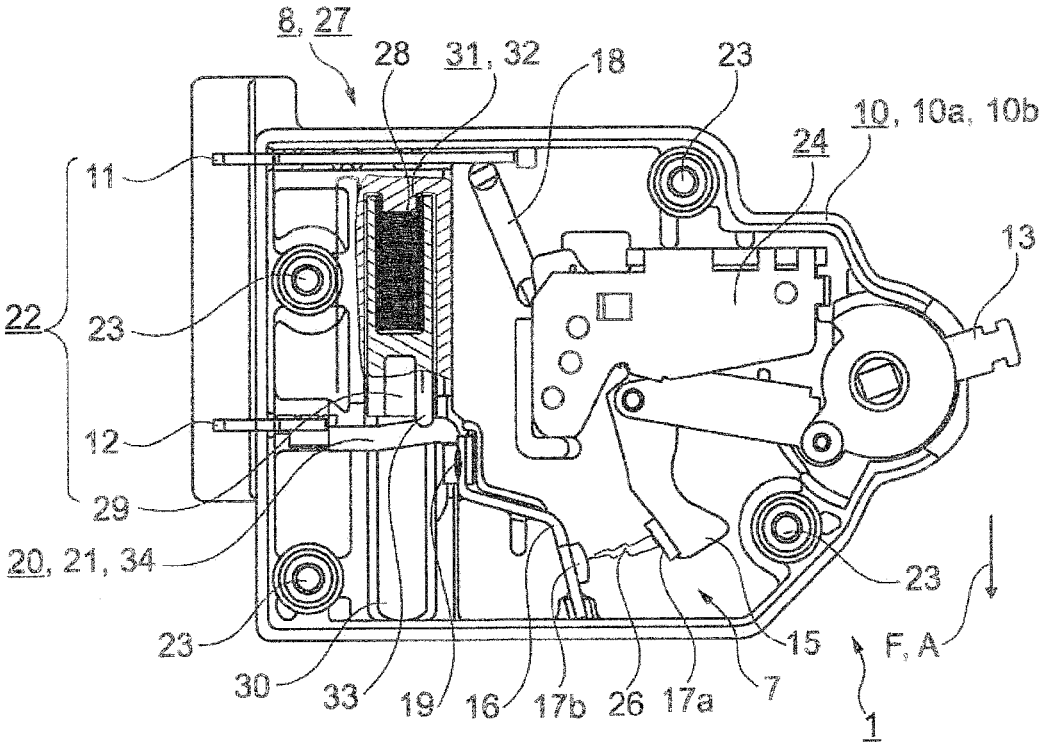
FIG. 3 is a diagrammatic, sectional view of the switchgear unit shown in FIG. 1 when a mechanical contact system is opened and when an arc is formed.

The contact crossbar 15 is electrically conductively coupled to the connection 11 by a fixed stranded conductor 18, with both the connection between the contact crossbar 15 and the stranded conductor 18 and the connection between the stranded conductor 18 and the connection 11 being in the form of a weld joint. The contact crossbar 15 is generally hammer-shaped and made from an electrically conductive metal, the contact area 17*a* being arranged at the hammer head end and resting on the contact area 17*b* in a closed position of the switchgear unit 1 (FIG. 2).

The contact carrier 16 is made from copper, which means that it has a high level of electrical and thermal conductivity. The contact carrier 16 has generally the shape of a step, with the contact area 17*b* being arranged at the upper step edge. The step body of the contact carrier 15 has a tapered cross section in order to increase the thermal conductivity thereof. A moving stranded conductor 20 is electrically conductively coupled at the lower step edge by a solder 19.

The stranded conductor 20 may have an electrically insulating shield 21 which has been removed at both ends of the stranded conductor. One of the conductor ends (fixed end) of the stranded conductor 20 is connected to the connection 12 nondetachably by welding, while the other conductor end (loose end) is soldered to the contact carrier 15 by the solder 19.

In the closed position of the switchgear unit 1, the circuit is therefore closed by virtue of the two connections 11 and 12 and the main current path 6. The current flows through a conductor path 22 which is thus formed, containing the connection 11, the stranded conductor 18, the contact crossbar 15, the contact areas 17*a* and 17*b*, the contact carrier 16, the solder 19, the stranded conductor 20 and the connection 12. The conductor path 22 runs in an approximate U shape within the housing 10.

Figure 5:
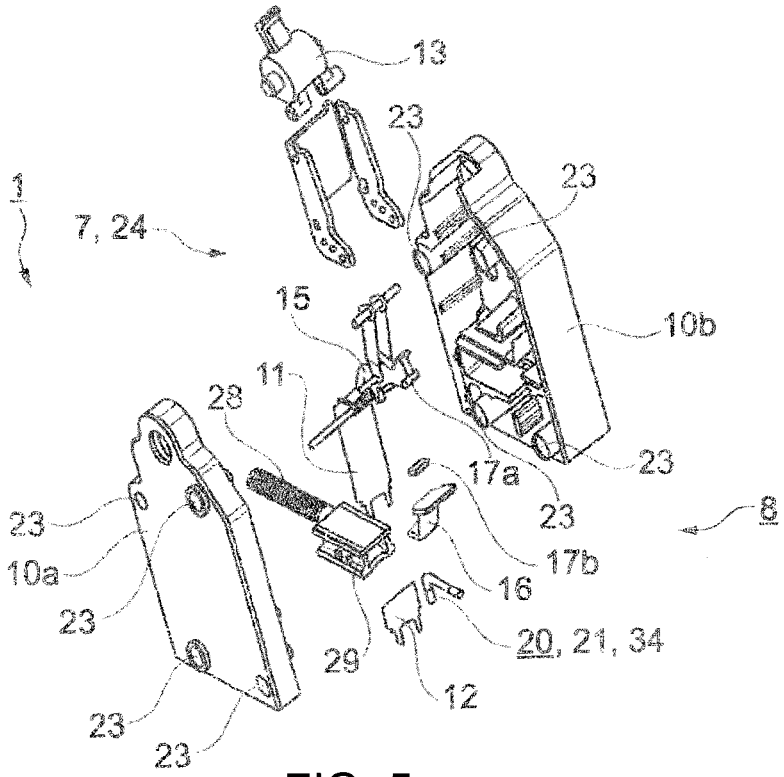
FIG. 5 is a diagrammatic, exploded perspective view of the switchgear unit.
Figure 6:
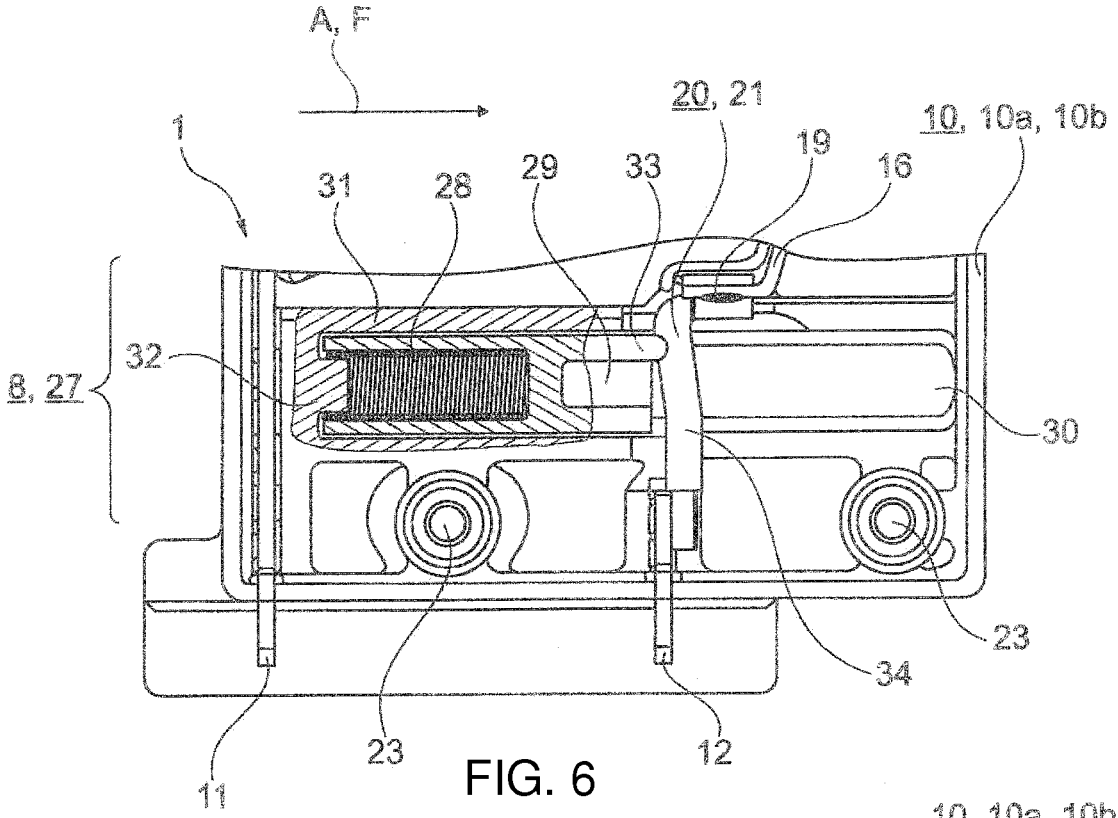
FIG. 6 is a detailed sectional view of the isolating apparatus.

The housing 10 contains an electrically insulating and heat-resistant plastic and is—as can be seen in FIG. 5—formed from two complementary housing half-shells 10*a* and 10*b*. The half-shells 10*a* and 10*b* can be connected to one another by four holes 23 using screws or rivets (not shown further). The holes 23 are arranged in an even distribution on the housing 10 approximately at the corner points of an imaginary square.

The housing 10 has an approximately rectangular cross section, so that simple assembly of a plurality of switchgear units 1 arranged next to one another or a common printed circuit board is possible. The housing 10 has an approximately U-shaped extent, with the two U limbs being connected to one another by a horizontal portion. Projecting from this horizontal portion are the two connections 11 and 12, and at the U base at least partially the rocker lever 13. In addition, the half-shells 10*a* and 10*b* are configured to have corresponding internal profile structures into which the individual parts of the switchgear unit 1 can be inserted using the interlocking shapes or with play.

Figure 4:
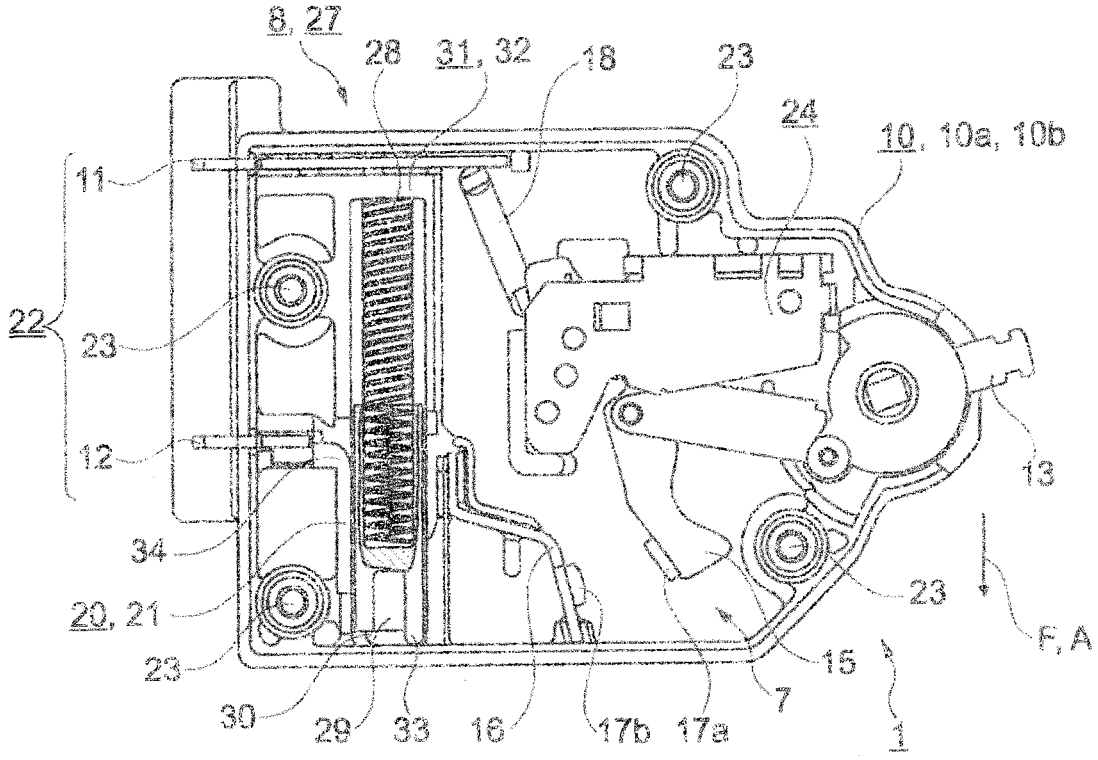
FIG. 4 is a diagrammatic, sectional view of the switchgear unit shown in FIG. 1 and in FIG. 2 after a failsafe system has been tripped.

The rocker lever 13 is used not only for opening and closing the contact system 7 but also as an external visual indication of the switching state of the switchgear unit 1, as can be seen in FIG. 4, in which the rocker lever 13 is in the open position. When the rocker lever 13 is operated manually, an external force for toggling the switch is converted into a pivot movement for the contact crossbar 15 by an articulation system 24.

The failsafe system 8 ensures permanent DC isolation between the PV generator 2 and the inverter 3. The failsafe system 8 contains the contact carrier 16, the solder 19, the stranded conductor 20, an isolating apparatus 27 with a spiral compression spring 28 and a slider 29 and also an insulating chamber 30. This variant embodiment of the isolating apparatus 27 is shown in more detail in FIG. 6.

The compression spring 28 is situated in a guide chamber 31 of the housing 10, with a pin-like extension 32 of the guide chamber 31 being embraced at least in part by the compression spring 28. The compression spring 28 pushes the slider 29 against the stranded conductor 20 on account of a spring restoring force F. The slider 29 has an extension which is the form of a finger 33 and which pushes directly against the stranded conductor 20. In this case, the finger 33 begins close to the solder 19, as a result of which the torque acting on the soldering, on account of the spring restoring force F, is as low as possible.

The guide chamber 31 and the insulating chamber 30 are at one level in a breaking direction A and are isolated from one another by the stranded conductor 20, which runs perpendicular thereto. The guide chamber 31 and the insulating chamber 30 furthermore have the same (slider-like) cross section.

In the event of a fault, an arc 26 produced heats the contact areas 17*a* and 17*b* and hence also the contact carrier 16 on account of the disproportionately increasing heat generation. On account of the high thermal capacity of the contact carrier 16, the solder 19 is heated to a comparable extent and is ultimately melted. As a result, the spring restoring force F of the compression spring 28 moves the slider 29 into the insulating chamber 30 in the breaking direction A. The slider 29 and the insulating chamber 30 are of geometrically complementary design, which means that they can be pushed into one another without difficulty. The squeezing-in length of the insulating chamber 30 expediently matches the performance parameters of the PV generator 2 in this case.

While the slider 29 is being moved into the insulating chamber 30, the stranded conductor 20 is pivoted about a center of rotation 34, and is ultimately bent through approximately 90° (FIG. 4). When the solder 19 melts and breaks, a second arc (not shown) is formed between the contact carrier 16 and the loose end of the stranded conductor 20, which runs approximately along the connecting line for these in the broken state. The second arc is first extended, and thereby cooled, by virtue of the slider 29 being moved and is second squeezed in between the slider 29 and the insulating chamber 30 on account of the matching shape between these, and hence extinguished. As soon as the second arc has been extinguished, the contact carrier 16 and the stranded conductor 20 are DC isolated, as a result of which the arc 26 is also simultaneously extinguished. The finger 33 promotes the breaking of the soldering and completely encapsulates or cuts off the second arc when it strikes the bottom of the insulating chamber 30.

Both the slider 29 and the internal walls of the insulating chamber 30 may be manufactured from a degassing and electrically insulating plastic material. The heat generation in the surroundings of the second arc, particularly in the region of the isolating apparatus 27, releases gases from these plastic materials. The gases hamper ionization of the air gap in the region of the broken solder 19 or help the ionization to die down faster. As a result, the second arc is easier for the isolating apparatus 27 to extinguish.

In the broken state (FIG. 4), the conductor path 22 of the switchgear unit 1 accordingly has two DC isolation locations, namely firstly between the contact areas 17*a* and 17*b* and secondly between the contact carrier 16 and the loose end of the stranded conductor 20. The materials and dimensions of the switchgear unit 1 and the isolating apparatus 27 thereof are dimensioned as appropriate in order to ensure interruption of direct current between the PV generator 2 and the inverter 3 within a few milliseconds even in the event of a fault.

Figure 7:
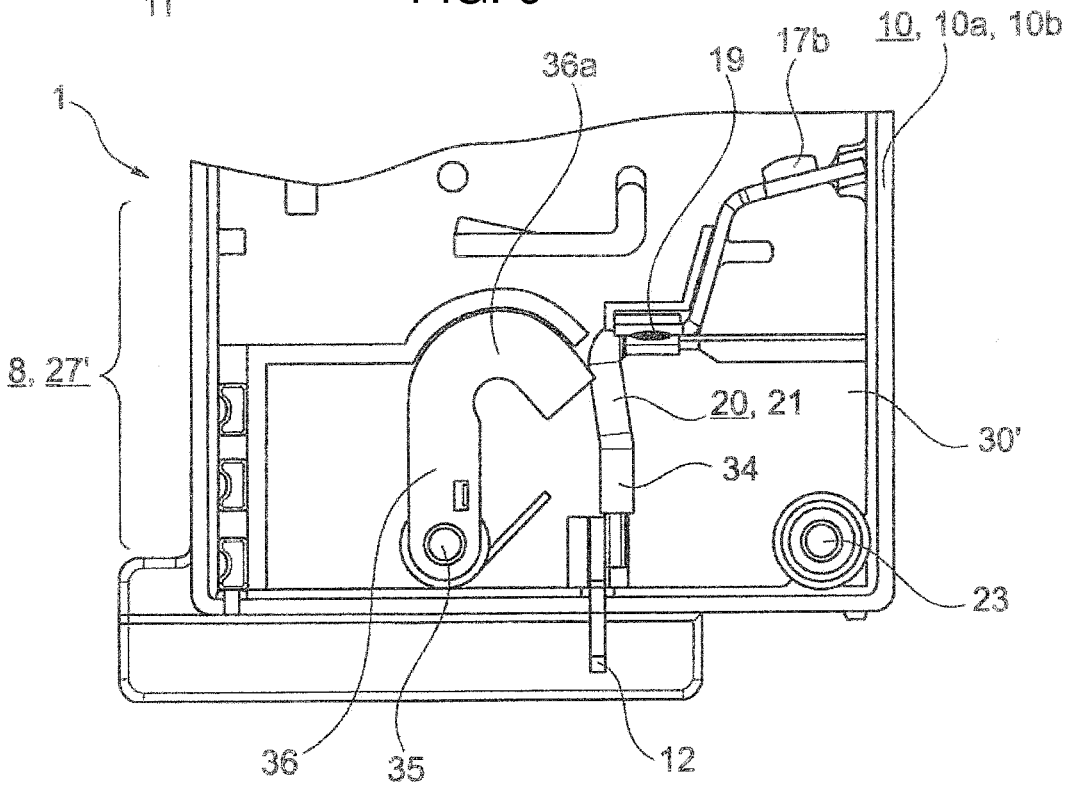
FIG. 7 is a sectional view of details of the switchgear unit with an alternative isolating apparatus.
Figure 8:
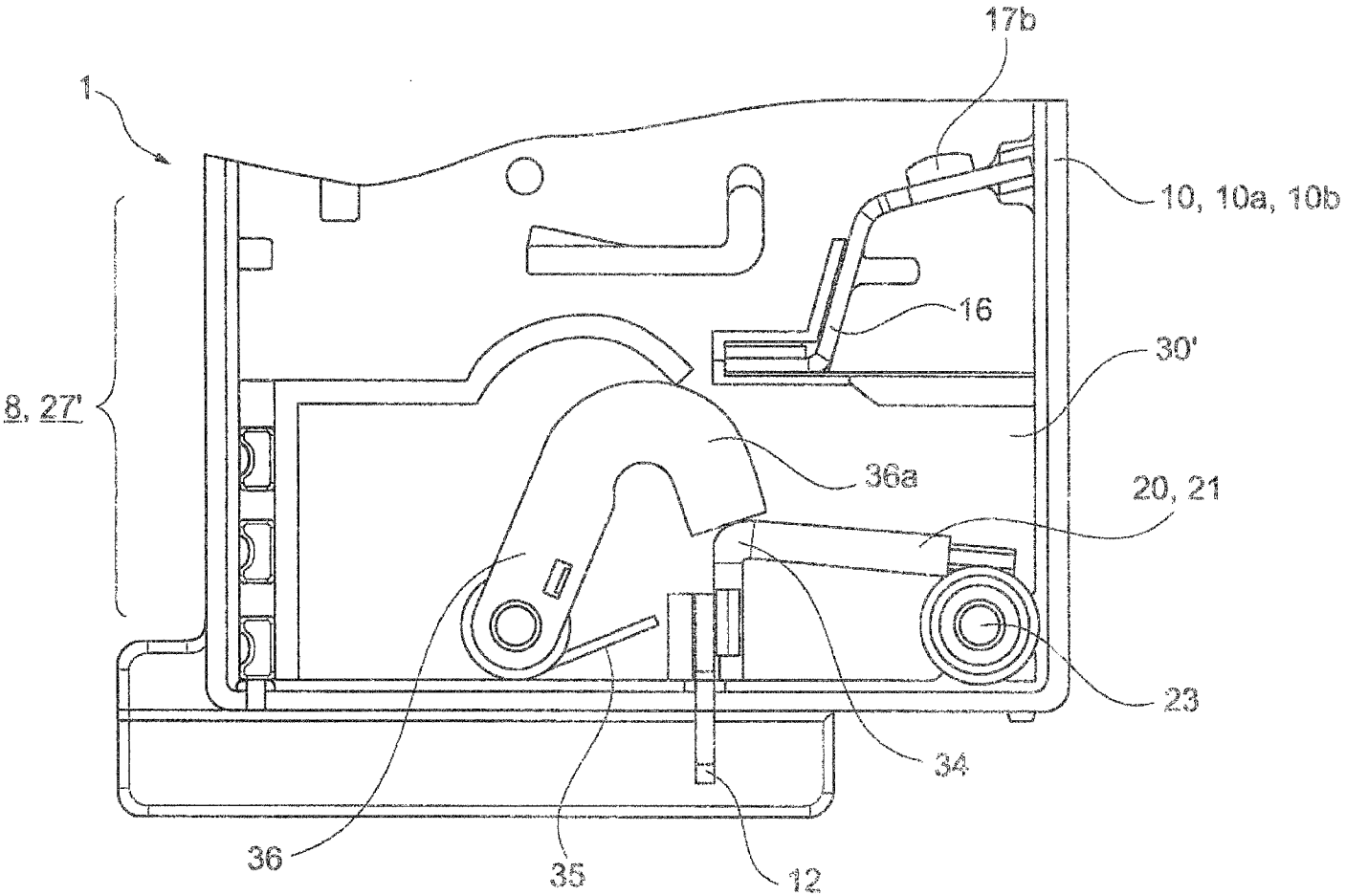
FIG. 8 is a sectional view of details of the switchgear unit shown in FIG. 6 in the tripped failsafe state.

A second variant embodiment of the switchgear unit 1 with an isolating apparatus 27' is explained below with reference to FIG. 7 and FIG. 8, where —as an aid to clarity—only the second half of the conductor path 22 (the contact carrier 16, the solder 19, the stranded conductor 20 and the connection 12), which is relevant to the failsafe system 8, is shown. The isolating apparatus 27' containing a prestressed leg spring 35, an approximately hook-like pivot head or lever 36 and an insulating chamber 30'. The internal profile of the housing 2 is set up and shaped to correspond to the isolating apparatus 27'.

In this embodiment, the insulating chamber 30' is essentially the lower half (starting from the top hat rail 12) of the housing 10. The pivot head (pivot lever) 36 is approximately L-shaped, with both the pivot head 36 and the insulating chamber 30' being manufactured from a degassing electrically insulating plastic material. The upper corner 36*a* of the horizontal L-limb of the pivot head 36 begins at the litz wire 20 in a similar manner to the finger 33 in the variant described previously. Arranged at the lower end of the vertical L-limb of the pivot head 36 is the prestressed leg spring 35. The leg spring 35 holds the pivot head 36 so as to move in pivot fashion or in rotary fashion.

When the solder 19 melts on account of the heat generation by the arc 26, the leg spring 35 pivots the pivot head 36 on account of a spring restoring force F'. In this case, the litz wire 20 is pivoted about the center of rotation 34' through an angle of approximately 90° in the direction of the lower right-hand corner of the housing 10 or of the insulating chamber 30'.

In contrast to the first exemplary embodiment, the arc is not squeezed in but rather is merely artificially extended, as a result of which the arc plasma can be extinguished on account of the resultant cooling. In this case, the arc is extended to a substantially greater extent in comparison with the first exemplary embodiment, since the stranded conductor 20 is not pushed in the direction of the right-hand side wall but rather is pivoted into the lower corner. The switchgear unit 1, with the isolating apparatus 27', is set up and suitable for ensuring interruption of direct current between the PV generator 2 and the inverter within a few milliseconds, both in the normal case and in the event of a fault.

When the housing size is dimensioned in suitable fashion, the horizontal contact area of the housing 10 on the top hat rail side is approximately 4 cm wide, the lateral edges of the housing are approximately 6 cm long and the housing 10 is approximately 2 cm deep. The distance between the contact areas 17*a* and 17*b* is approximately 1 cm in the open position, and the distance between the contact carrier 15 and the loose end of the stranded conductor 20 after the isolating apparatus 27 or 27' has been tripped is at least 1.5 cm. The plastics for the housing 10, the insulating chamber 30/30' and the slider 29 or pivot head 35, the shape and material of the contact carrier 16 and also the torque acting on the solder 19 are chosen such that the switchgear unit 1 has a rated voltage of approximately 1,500 V (DC).

The invention is not limited to the exemplary embodiments described above. On the contrary, it is also possible for other variants of the invention to be derived by a person skilled in the art without departing from the subject matter of the invention. In particular, all individual features described in connection with the different exemplary embodiments can, furthermore, also be combined with one another in a different way without departing from the subject matter of the invention.

The invention claimed is:

1. A switchgear unit for switching high DC voltages, the switchgear unit comprising:

a housing;

a conductor path;

two connections, including a first connection and a second connection, projecting from said housing and electrically conductively coupled by means of said conductor path;

a thermal fuse;

a mechanical contact system, disposed between said first and second connections, and having two contacts which can move relative to one another and can be transferred from a closed position to an open position;

an isolating apparatus being tripped by means of said thermal fuse, for extinguishing an arc produced when said contacts are opened;

a moving conductor section; and said thermal fuse having a melting location disposed in said conductor path and connected first to said contact system and second via said moving conductor section to said first connection, wherein said isolating apparatus being tripped and a connection between said conductor section and said mechanical contact system being broken at said melting location when the arc has caused a melting temperature of said melting location to be reached or exceeded.

2. The switchgear unit according to claim 1, wherein said isolating apparatus contains a prestressed spring element having a spring force acting indirectly or directly on said conductor section in a breaking direction.

3. The switchgear unit according to claim 2, wherein said spring element deflects said conductor section about a pivot point, which is at a distance from said melting location, when said isolating apparatus is tripped.

4. The switchgear unit according to claim 3, wherein said isolating apparatus deflects said conductor section through a pivot angle of greater than or equal to 90°.

5. The switchgear unit according to claim 1, wherein said housing has an insulating chamber which adjoins said melting location and in which said conductor section is situated when said isolating apparatus has been tripped.

6. The switchgear unit according to claim 5, wherein said isolating apparatus has an isolating element which is held in said housing so as to move and which is directed against said conductor section.

7. The switchgear unit according to claim 6, wherein said isolating element, having been tripped, covers said conductor section so as to provide at least partial insulation from said melting location.

8. The switchgear unit according to claim 6, wherein said isolating element is directed in said housing so as to move in sliding fashion and, when said isolating apparatus is tripped, enters said insulating chamber together with said conductor section.

9. The switchgear unit according to claim 6, wherein said isolating element is held in said housing so as to move in rotary fashion and, when said isolating apparatus is tripped, pivots said conductor section about a pivot point, which is at a distance from said melting location.

10. The switchgear unit according to claim 1, wherein said contact system has a moving contact and a fixed contact, wherein said melting location is coupled to said fixed contact by means of one of said two contacts being an electrically conductive contact carrier so as to conduct heat.

11. The switchgear unit according to claim 10, further comprising:

a rocker lever; and a trip mechanism, said moving contact is coupled to said rocker lever for operating said contact system by means of said trip mechanism.

12. The switchgear unit according to claim 1, wherein said conductor section is a flexible connecting element, said flexible connecting element having a fixed end soldered nondetachably to said first connection and a loose end soldered at said melting location.

13. The switchgear unit according to claim 1, wherein said housing holds said conductor path, said mechanical contact system, said isolating apparatus and said thermal fuse.

14. The switchgear unit according to claim 6, wherein said housing and said isolating element are made from a thermally stable plastic material.

15. The switchgear unit according to claim 6, wherein at least one of said isolating element and said insulating chamber are made from a plastic material which degases in an event of fire.

16. The switchgear unit according to claim 1, wherein said contact system has two moving contacts, wherein said melting location is coupled to one of said moving contacts by means of one of said two contacts being electrically conductive contact carrier so as to conduct heat.

17. The switchgear unit according to claim 10 wherein said conductor section is a stranded conductor, said stranded conductor having a fixed end soldered nondetachably to said first connection and a loose end soldered at said electrically conductive contact carrier.

18. The switchgear unit according to claim 6, wherein said housing and said isolating element are made from a thermoset material.

19. The switchgear unit according to claim 6, wherein at least one of said isolating element and said insulating chamber are made from a polyamide material which degases in an event of fire.

20. An isolating apparatus for interrupting direct current between a direct current source and an electrical device, the isolating apparatus comprising:

a switchgear unit for switching high DC voltages, said switchgear unit containing:

a housing;

a conductor path;

two connections, including a first connection and a second connection, projecting from said housing and electrically conductively coupled by means of said conductor path;

a thermal fuse;

a mechanical contact system, disposed between said first and second connections, and having two contacts which can move relative to one another and can be transferred from a closed position to an open position;

the isolating apparatus being tripped by means of said thermal fuse, for extinguishing an arc produced when said contacts are opened;

a moving conductor section; and said thermal fuse having a melting location disposed in said conductor path and connected first to said contact system and second via said moving conductor section to said first connection, wherein the isolating apparatus being tripped and a connection between said conductor section and said contact system being broken at said melting location when the arc has caused a melting temperature of said melting location to be reached or exceeded.

21. The isolating apparatus according to claim 20, wherein: the direct current source is a photovoltaic generator; and the electrical device is an inverter.

* * * * *